US009592417B2

(12) United States Patent
Miyoshi

(10) Patent No.: US 9,592,417 B2
(45) Date of Patent: Mar. 14, 2017

(54) MULTI-PURPOSE FITNESS DEVICE

(71) Applicant: Katuyuki Miyoshi, Hiroshima (JP)

(72) Inventor: Katuyuki Miyoshi, Hiroshima (JP)

( * ) Notice: Subject to any disclaimer, the term of this patent is extended or adjusted under 35 U.S.C. 154(b) by 0 days.

(21) Appl. No.: 15/260,894

(22) Filed: Sep. 9, 2016

(65) Prior Publication Data

US 2017/0028242 A1 Feb. 2, 2017

Related U.S. Application Data

(63) Continuation of application No. PCT/JP2015/057966, filed on Mar. 2, 2015.

(30) Foreign Application Priority Data

Mar. 11, 2014 (JP) ..... 2014-047456

(51) Int. Cl.
*A63B 21/04* (2006.01)
*A63B 21/055* (2006.01)
(Continued)

(52) U.S. Cl.
CPC ..... *A63B 21/0442* (2013.01); *A63B 21/0557* (2013.01); *A63B 21/4033* (2015.10);
(Continued)

(58) Field of Classification Search
CPC ..... A63B 21/0442; A63B 21/4033; A63B 21/0557; A63B 21/002; A63B 21/0023;
(Continued)

(56) References Cited

U.S. PATENT DOCUMENTS 6,902,514 B2 * 6/2005 Chuang ..... A63B 22/001 482/147
7,419,549 B2 * 9/2008 Schwersenz ..... B05C 5/005 118/411
(Continued)

FOREIGN PATENT DOCUMENTS

JP 9-192258 7/1997
JP 2001-259074 9/2001
(Continued)

OTHER PUBLICATIONS

International Search Report of PCT application No. PCT/JP2015/057966 dated Mar. 2, 2015.
(Continued)

*Primary Examiner* — Sundhara Ganesan
*Assistant Examiner* — Megan Anderson
(74) *Attorney, Agent, or Firm* — Culpepper IP, PLLC; Kerry S. Culpepper

(57) ABSTRACT

The multi-purpose fitness device is provided in a comfortable posture such as being seated, face up or face down, to generate twisting of various body sites, loosen muscle stiffness in hypokinetic people, and promote blood circulation intermixed with muscle training, for recovery, maintenance and promotion of health. Dieting, rehabilitation, massage, stretching, cellulite prevention, and metabolic syndrome prevention exercise are addressed. For generating twisting in various body sites, the multi-purpose fitness device comprises: main body having a rotatably supported strut, a repetitive drive unit connectably disposed below the strut, upper and lower wings fixed to both side surfaces of struts, and a pad driver slidably connected on the top part of strut; and pad parts as accessories. By flexibly transmitting rotation of the main body units movable front-to-back,
(Continued)

left-to-right and up-and-down to a human body, twisting exercises become possible in exercise bodily free positions.

5 Claims, 19 Drawing Sheets

(51) Int. Cl.
*A63B 23/035* (2006.01)
*A63B 23/00* (2006.01)

(52) U.S. Cl.
CPC .. *A63B 23/03516* (2013.01); *A63B 2023/003* (2013.01); *A63B 2225/10* (2013.01); *A63B 2225/102* (2013.01)

(58) Field of Classification Search
CPC ... A63B 21/22; A63B 21/222; A63B 21/4047; A63B 21/4049; A63B 23/03516; A63B 2225/10; A63B 2225/102; A63B 2023/003
See application file for complete search history.

(56) References Cited

U.S. PATENT DOCUMENTS

2008/0064572 A1* 3/2008 Nardone ..... A63B 21/012 482/52
2015/0038300 A1* 2/2015 Forhan ..... A63B 21/00047 482/72
2015/0111706 A1* 4/2015 Broadhurst ..... A63B 22/0076 482/72
2016/0016038 A1* 1/2016 Maholmes ..... A63B 23/0211 482/127
2016/0096058 A1* 4/2016 Lin ..... A63B 21/0053 482/2

FOREIGN PATENT DOCUMENTS

| | | |
|---|---|---|
| JP | 3369144 | 11/2002 |
| JP | 2002-360736 | 12/2002 |
| JP | 2004-166871 | 6/2004 |
| JP | 2006-110326 | 4/2006 |
| JP | 2008-149029 | 7/2008 |
| JP | 2009-119043 | 6/2009 |

OTHER PUBLICATIONS

Written Opinion of the International Search Authority application No. PCT/JP2015/057966 dated May 19, 2015.

* cited by examiner

MULTI-PURPOSE FITNESS DEVICE

CROSS-REFERENCE TO RELATED APPLICATION

This application is a continuation application of International Application PCT/JP2015/057966, filed on Mar. 2, 2015 which designated the U.S., the entire contents of which are incorporated herein by reference.

FIELD

The present invention relates to a multipurpose fitness device.

BACKGROUND ART

While conventional manual exercise equipment is intended to train the muscles by applying a load to the body, an electrically driven exercise machine recently disclosed conducts: repeated rotation of the foot mounting table, rotating a seat body, or repeated rotation of the seat surface. In patent publications referenced case (rotary type exercise device), the upper surface of the rotary plate is erected on a rotating plate which is inclined upward toward the front, and a repetition driving device composed of a motor and a cam, etc. allows the rotary plate to repeatedly rotate in forward and reverse directions for exercise of the twisting motion of the waist (Patent Document 1, Japanese Unexamined Application Publication No. 2009-119043).

In patent publications referenced (chair exercise equipment), the seat body is rotated by a driving unit composed of the motor, the belt and the eccentric disc while sitting on a chair in a state the axis of the seat body is inclined outward, in order to vigorously move the human body (Patent Document 2, Japanese Unexamined Application Publication No. 2008-149029).

In the patent publication referenced (only the seat surface of the chair is the chair can sit-ups to rotate), the upper body is fixed to the backrest and armrests, for the abdominal exercises while sitting on a chair whose seat surface is driven by motor to turn for a half circle (Patent Document 3, Japanese Unexamined Application Publication No. 2004-166871).

Many adult people suffer from poor physical conditions due to lack of exercise. But the exercise equipment disclosed in the Patent Documents 1 to 3 only for turning the waist or the abdomen is problematic in that neck, arms, shoulders, back, pelvis, buttocks, thigh, calf and legs can not be exercised.

While many of the elderly, have been plagued by muscle pain and fatigue, the exercise equipment disclosed in the Patent Documents 1 to 3 only for turning the waist or the abdomen can not resolve the stiffness or malaise appearing throughout the body.

Many people are troubled with obesity, but there is a problem that the exercise equipment only turning the waist or the abdomen disclosed in Patent Documents 1 to 3 cannot reduce the fat in shoulder, back, buttocks, thighs or calf where the fat is easily accumulated.

In a conventional exercise equipment, no single equipment can do everything Thus unavoidably, it had been symptomatically justified to buy a lot of exercise equipment. It is economically redundant and gets in the way by accumulated non-use goods.

SUMMARY

The product of the present invention allows repetitive motion while moderately twisting neck, arms, shoulders, shoulders, hips, abdomen, pelvis, hip, thigh, calf and legs, where the user intends to exercise with the aid of power in a comfortable position, such as sitting position, lying on his back and lying on his stomach. Further, the product of the present invention is intended to provide a multipurpose fitness device that relaxes the stiffness, promotes blood circulation, and allows muscle training for people lack of exercise, in order to achieve recovering, maintenances and promotion of health. Furthermore, diet, rehabilitation, massage, stretching, cellulite prevention, and metabolic syndrome prevention campaign are also the objects of the present invention.

Direction shown in the present invention describes a direction as viewed from the body side. The multi-purpose fitness device according to claim 1 comprises a main body A and a pad unit 7. The main body comprises a strut 41 and a repeat drive unit 51 for generating a torsional on parts of a human body. The strut 41 is vertically supported to pivot and the repeat drive unit 51 is arranged connectable to a lower tip of the strut in order to repeat rotating the strut. The main body A further comprises: an upper wing 11 which is substantially rod-shaped, fixed to an upper side of the strut 41 to be a horizontally symmetric in order to impart a swirling force in a back or forward direction with respect to the human body around the vertical axis of the strut as a center; and a pad driver 32 connectable to the upper side of the strut 41 in order to impart swirling forces in a horizontal direction with respect to the human body around the vertical axis of the strut as a center and in a horizontal direction with respect to the human body around the vertical axis of the strut as a center, the pad driver 32 fixing the pad. The pad unit 7 is an accessory removably connected to the upper wing 11 or adhered to the pad 35, and configured to transmit the swirling force in back, forth, horizontal and vertical directions of the main body A.

A description will be given of the operation by the resolution unit for body A. The repetitive driving device 51 as a power source is activated to allow the strut 41 to repeatedly rotate, to apply a turning force in the back/front direction to the upper wing 11 located on the side of the strut 41, to apply a turning force in the lateral direction to the pad 35 located in front of the strut 41, and further to apply a turning force in the back and forth direction to the pad 35 by activating the pad drive unit 32, in order to perform a whole body movement with twisting.

The effect of the resolution unit for the pad portion 7 will be explained. By selecting from the accessory the pad portion 7 corresponding to the portion to be moved; connecting to the upper wing 11 of the body A or to adhering to the tip of the pad 35; and conveying the turning force of the body side flexibly to the body side through the pad 7, it is possible to perform exercise at a higher position of the physical flexibility.

By combining the solution according to the main body A and the pad portion 7, it is possible to provide a versatile fitness device capable of systemically twisting motion at a high position of the physical flexibility.

In the multipurpose fitness device according to claim 2 based on claim 1, the repetitive driving device 51 comprises an automatically repeated rotator of the strut 41 at a predetermined swing angle, providing a back and forth swirling force on the upper wing 11 connected to the strut 41 around the longitudinal axis of the strut with respect to the human body and providing a swirling force in the lateral direction to the pad 35 around a longitudinal axis with respect to the pad driver.

Hereinafter, the action of the invention in claim 2 is described. The repetitive driving device 51 includes a rotation/repeat conversion mechanism 51*c*, converting the rotation of the brushless DC motor motor 51*a* for the repetitive driving device 51 into the repeated rotation of the strut 41.

In the multipurpose fitness device according to claim 3 based on claim 1 or claim 2 allows the upper wing 11 fixed to the upper side of the strut 41 in horizontal symmetry to adjust the turning radius, freely changing the stroke in the back and forth direction relative to the body.

Hereinafter, the action of the invention in claim 3 is described. It has an effect that the turning radius and the back and forth stroke of the upper wing 11 can be adjusted according to the size of the portion for exercise.

In the multipurpose fitness device according to claim 4 based on any one of claims 1 to 3, the pad drive device 32 comprises a coupling unit slidably rotatably connected to the top of the strut 41, freely changing the lateral direction of the orientation of the pad drive device 32.

The action of the invention in claim 4 is described. The inner shaft 32*e* protruding to the lower side of the bearing seat 32*d* of the pad drive unit 32, is provided with a plurality of small hole arrays for locking (not shown), to be engageable with the locking mechanism 42. By unlocking the lock mechanism 42, sliding rotation of the bearing seat 32*d* at a predetermined angle or by to the left and the right, it is possible to change the orientation in the direction of the pad driving unit 32 for easy movement.

In the multipurpose fitness device according to claim 5 based on any one of claims 1 to 4, the pad drive device 32 comprises a pivoting unit for movement of the pad fixed to the pad driving unit 32 in a vertical direction.

The action of the invention in claim 5 is described. The pad drive device 32 comprises the DC geared motor 32*a* with a torque limiter, a worm 32*b*, the worm wheel 32*c*, the bearing seat 32*d*, and the inner shaft 32*e*, allowing the pad 35 to pivot in the vertical direction.

In the multi-purpose fitness device according to claim 6 based on any one of claims 1 to 5, the pad 35 is provided with means for adjusting the turning radius of the pad, allowing the strokes to be freely changed in a vertical direction relative to the body around the horizontal axis of the pad driving unit and in the horizontal direction with relative to the body around a vertical axis.

The action of the invention in claim 6 is described. By putting the inner cylinder 35*a* constituting the pad 35 in and out of the outer tube 35*c*, the stroke of the turning radius and the vertical direction or the horizontal direction can be adjusted according to the amount of movement of the up, down, or left and right directions of a portion desired to movement.

In the multi-purpose fitness device according to claim 7 based on any one of claims 1 to 6, a lower wing 21 is horizontally symmetrically fixed to a lower side surface of the strut 41 and comprises means for adjusting the turning radius, freely changing the stroke of the back and forth direction relative to the body.

The effect of the invention of claim 7 will be explained. It has an effect that the stroke of the turning radius and the back and forth direction of the lower wing 21 can be adjusted depending on the back and forth movement amount of the portion for movement.

In the multi-purpose fitness device according to claim 8 based on any one of claims 1 to 7, the pad unit 7 is a shoulder belt 711 formed by an annular ring band 711*b* fixed to both ends of an elastic belt 711*a*, and a pad for shoulder formed between a cord 711*c* with a hook 711*d* movably connected 25 along the ring of the annular band 711*b* and a cord with a grip ring.

The action of the invention in claim 8 is described. In a sitting position, the shoulder pad 711 is mounted on a shoulder, the hooks 711*d* are connected to the retaining ring 12*b* via the preload device 722, the iteration drive unit 51 is started, and the gripping ring 711*f* is gripped, for upper body movement while propagating the torsion to the shoulder, scapula, back, the abdomen.

In the multipurpose fitness device according to claim 9 based on any one of claims 1 to 7, the pad portion 7 is a rug pad for pelvis 712 comprising means for increasing the contact pressure on the human pelvic side when the pad turns to the left-right direction, which is formed by a mat 712*a*, and the surface fastener 712*c* and a substantially semicircular plate-like elastic body 712*b* provided with an inclined surface at the horizontally symmetric periphery of an arc shape to be movable on the mat 712*a*.

The actions of the invention described in claim 9 are: first attaching the spherical pad 719 at the tip of the pad 35, being in a supine position, spreading the pelvis coverings pad 712 to the buttocks, then activating the iteration drive unit 51, falling the standing knees from a side and performing lower body twisting movement to propagate the torsion to the leg, thigh, pelvis, abdomen, hips and the back while performing a pelvic movement at the same time.

The multipurpose fitness device according to claim 10 based on any one of claims 1 to 7, the pad portion 7 is a rug pad for both abdomen and waist 713 forming a horizontal symmetry by a substantially rectangular elastic body 713*a* curved like an arch shape a low central portion and vertically higher right and left end sides; and a circular flat elastic body 713*b* of a double-half circle shape, disposed symmetrical to the substantially rectangular elastic body to form a circle from a plan view, so that the top surface inclines upward toward the front in a side view.

It will explain the effect of the invention according to claim 10. Following actions are conducted: first attaching the waist belt 721 to the waist, connecting the hooks 721*d* to the retaining ring 12*b* via the preload device 722, then, laying the lower abdomen on the rug pad for both abdomen and waist 713, starting the iteration drive device 51, and performing the abdomen waving motion while swung to the left and right of the lower abdomen.

According to the invention of claim 1, by combining the main body A having means for imparting a swirling force to the front and rear, right and left, up and down directions to the human body, with a pad unit 7 that flexibly transmits the turning force of the body A side to the human body, there is an effect that whole body twisting motion is possible in a posture of the physical degrees of freedom.

According to the invention of claim 1, since diet, rehabilitation, massage, stretch, cellulite prevention, and metabolic preventive effect are expected other than the torsional movement, it is not necessary to purchase an exercise machine in symptomatic manner. The space may be small.

According to the invention of claim 2, wherein the repetitive driving device 51 having a rotary/repetitive conversion mechanism 51*c* allows the struts 41 repetitive rotation. The repetition in back and forth movement of the upper wing 11 coupled to the strut 41 allows upper body movement. The repetition of pivotin in the lateral direction of the pad 35 allows lower body movements According to the invention of claim 2, struts 41 which follows the repetitive rotation of the repetitive driving device 51, automatically the accelerates after the reversal and the reduces the speed before inversion so that the shockless movement becomes possible.

According to the invention of claim 3, the upper wing 11 is a moving part that repeats turning in the back and forth direction relative to the body. By moving the saddle 12 disposed on the upper wing 11 left or to the right to regulate the turning radius of the saddle 12 and changing freely the back and forth direction of the stroke, the back and forth motion becomes possible.

According to the invention of claim 4, on the side surface of the inner shaft 32*e* protruding to the lower portion of the pedestal 32*d*, a plurality of small holes for locking are arranged to be engageable with the lock mechanism 42. By unlocking the lock mechanism 42, thereby sliding and pivoting the bearing plate 32*d*, it is possible to freely change the direction of the pad driving unit 32 to which the movement becomes easy for exercising.

According to the invention of claim 5, the pad 35 fixed to the pad driving unit 32 is a moving part that pivots in the vertical direction with respect to the human body. By adhering the spherical pad 719 at the tip of the pad 35, starting the pad driving unit 32, and gripping the spherical pad 719 by hand, vertical movement of the arm becomes possible.

According to the invention of claim 6, the pad 35 is a moving part that pivots in up and down directions or in the lateral direction with respect to the human body. By putting the inner cylinder 35*a* in and out of the outer cylinder 35*c*, the turning radius, vertical, or horizontal direction of the stroke are freely changed, allowing the horizontal motion and the vertical motion.

According to the invention of claim 7, the lower wing 21 is a moving part that repeats turning in the back and forth direction of the human body. By selecting the stop ring 21*a* arranged in a row on the lower wing 21, the turning radial and back and forth directions of the strokes can be changed freely and pulling movements, such as the legs become possible.

According to the invention of claim 8, in a sitting posture, by mounting the shoulder pad 711 of the pad portion 7 on the shoulder, connecting the hooks 711*d* to the retaining ring 12*b* via the preload member 722, grasping the grasping ring 711*f* starting the repetitive driving unit 51 and performing the upper body movement while propagating twisting into the shoulder, the scapula, back and the abdomen, fatigue recovery effect of the upper body can be expected.

According to the invention of claim 9, following actions are conducted for distortion preventive effect of pelvis and fatigue of lower body: being in a supine position; spreading the pelvis coverings pad 712 to the buttocks; starting the iteration drive unit 51; laying with the spherical pad 719 while folding the standing knee; and performing lower body twisting movement to propagate the torsion to the leg, thigh, pelvis, abdomen, hips and the back while performing a pelvic movement at the same time.

According to the invention of claim 10, following actions are conducted: being in a prone position, attaching the spherical pad 719 at the tip of the pad 35, attaching the waist belt 721 to the waist, connecting the hooks 721*d* through the preload member 722 to the retaining ring 12*b*, then laying the rug pad for both abdomen and waist 713 on the lower abdomen, activating the repetitive driving unit 51, performing the contact pressure movement of the lower abdomen while swinging the lower body to the left and right, and allowing metabolic preventive effect of the abdomen.

DESCRIPTION OF EMBODIMENTS

The following is a description of embodiments of the present invention with reference to FIGS. 1 to 19.

Figure 1:
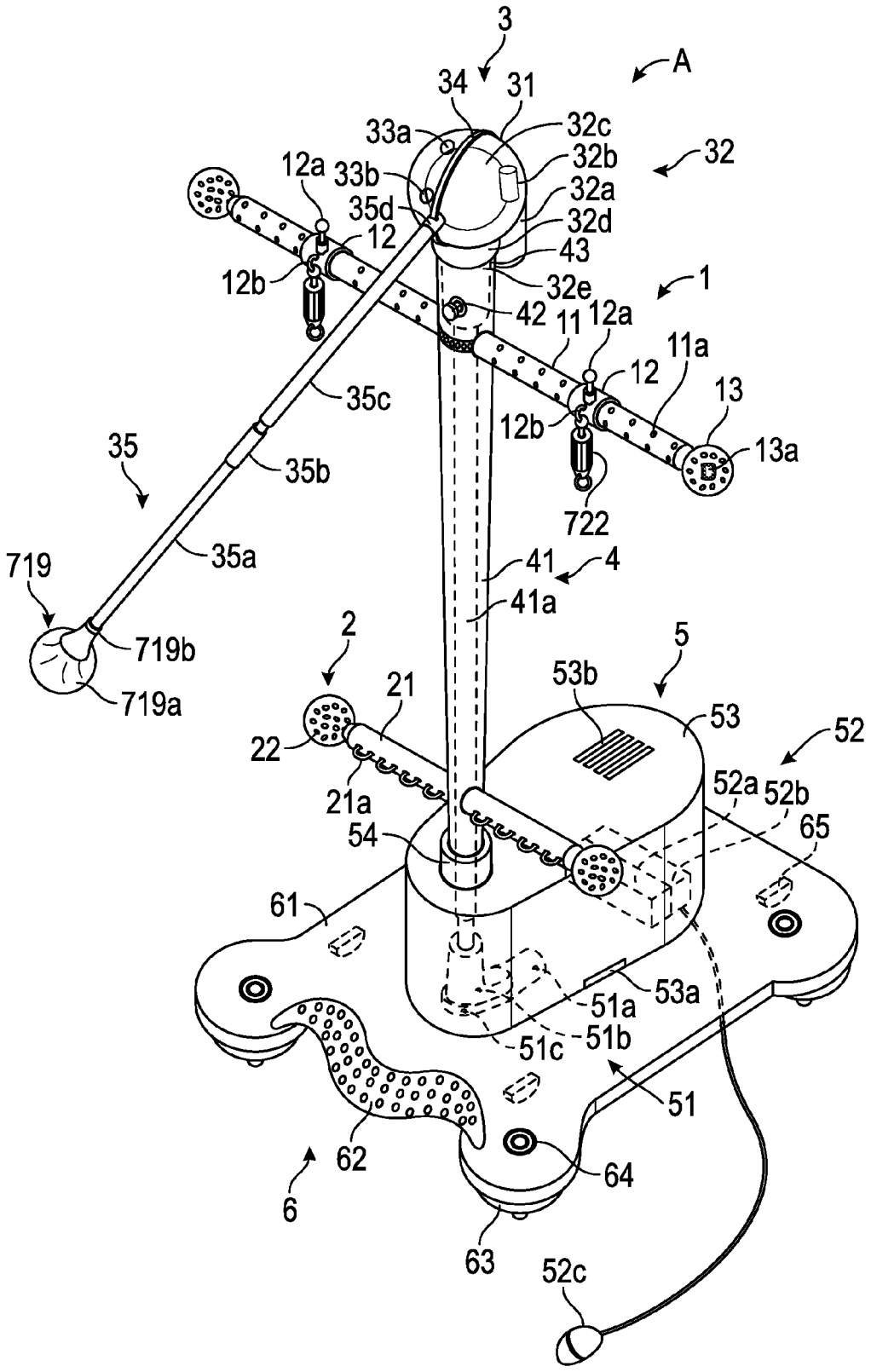
FIG. 1 is a perspective view of a body A.

FIG. 1 is a perspective view showing the body A. The body A comprises an upper wing 1, a lower wing portions 2, a complement driver 3, a strut unit 4, a main driving unit 5 is composed of a base plate 6. An upper wing 11 of the upper wing section 1 is provided with a plurality of small holes 11*a* in a plurality of rows on the upper wing 11 as a means of regulating the turning radius, and the saddle 12 with the locking mechanism 12*a* and the retaining ring 12*b*. Although not shown, the locking mechanism 12*a* is provided with a locking pin and a spring therein. At the distal end of the upper wing 11, the spherical elastic member 13 having a slip is detachably fixed. Further, at the upper center of the spherical elastic member 13, a square hole 13*a* is provided. Incidentally, it is possible that the small hole 11*a* is set to one row, and the locking ring 12*b* may be attached at two positions on the front and lower sides of the saddle 12. The locking mechanism 12*a* may be a screw. Although not shown, a guide trench may be provided on the front face of the upper wing to allow the saddle 12 to move.

The operation of the above configuration will follow. The upper wing 11 is a moving part that repeats turning in the back and forth direction. By unlocking the locking mechanism 12*a* and moving the saddle 12 counterclockwise to the left or right in order to change the stroke of the turning radius and the back and forth direction freely, it is possible to allow the twisting motion of the upper body and lower body. In addition, by choosing the retaining rings 12*b* attached to the saddles 12 alternately on the right and left, it is possible to prevent the coupling cord of cross hanging from interference due to contacting during exercising. The front of the lower wing 21 of the lower wing portions 2 is provided with a plurality of the retaining rings 21*a* arranged in a line as a means of regulating the turning radius. Further, at the front end of the lower wing 21, the spherical elastic member 22 for avoiding slipping is detachably fixed.

The operation of the above configuration will follow. The lower wing 21 is a moving part that repeats turning in the back and forth direction. By selecting the stop ring 21*a* to freely change the turning radius and back and forth stroke, it is possible to tow legs.

The pad driving unit 32 of the accessory drive unit 3, as means for pivoting movement of the pad 35 in a vertical direction, is provided with a DC gear motor 32*a* with the torque limiter, the worm 32*b*, the worm wheel 32*c*, a bearing seat 32*d*, the inner shaft 32*e*, the upper limit for the proximity switches 33*a* for limiting the pivoting movement in the vertical direction, and the lower limit for the proximity switch 33*b*. It should be noted that the bearing of the pad 35 may be oil-less metal, or may have a bearing. The worm wheel 32*c* may be a material having a lubricating property.

The torque limiter with DC geared motor 32*a* may be a brushless DC motor and be provided on the lower site of the strut to couple the pad drivers 32. The worm wheel 32*c* may be made of the material with self-smoothing. The pivoting in up-down directions may be restricted by a dumper intended to prevent the shock.

The upper limit 33*a* for the proximity switch and the lower limit 33*b* for the proximity switch may be the magnetic switch, photoelectric switch, or the limit switch and may limit the current of the motor instead of the torque limiter. It is also possible to use an anti-shock stopper instead of the proximity switch.

The operation of the above configuration will follow. The pad driver 32 is intended for pivoting movement of the pad 35 in the vertical direction. Vertical movable range of the pad 35 is limited by the upper limit 33*a* for the proximity switch and the above lower limit 33*b* for the proximity switch. As a result, it can be pivoted within a range of 150 degrees under the apex of the spherical body 31 as the upper limit. At the time of stop, it is possible to mechanically hold the pad 35 to the stop position by the self-locking of the worm 32*b*.

As a means for adjusting the orientation of the pad drive unit 32, the small holes for the lock, although not shown, are arranged in sequences to be engageable with the plurality of a lock mechanism 42 on the outer periphery of the inner 32*e* of the bearing seat 32*d*. The operation of the above configuration will follow. By releasing the locking mechanism 42 to freely slide and pivot the bearing seat 32*d*, the orientation of the pad drive unit 32 can be changed to the direction of easy movement within +/−60 degrees.

As a means for adjusting the turning radius, the pad 35 is provided with the inner cylinder 35*a*, a clamp 35*b*, an outer cylinder 35*c*, and a connector 35*d*. Although not shown, the base side of the connecting member 35*d* is fixed to the outer periphery of the worm wheel 32*c*. Although not shown, the distal end side of the connecting member 35*d* may be configured to have allowance.

The operation of the above configuration will follow. The pad 35 can move to the left and right directions, or the up-and-down directions by loosening the clamp 35*d*, putting the inner cylinder 35*a* in or out of the outer cylinder 35*c*, and freely changing the turning radius and the stroke in left and right or up-and-down direction. In addition, the upward external force applied during exercise on the pad 35 releases the pad 35 in the upward direction.

Substantially spherical body 31 of the auxiliary drive unit 3 has an elongated slit 34 in the front, and is couplably divided into the upper hemisphere and the lower hemisphere, although not shown. It should be noted that the substantially spherical body 31 may be divided into the right hemisphere and the left hemisphere.

The operation of the above configuration will follow. The substantially spherical body 31 has the effect of protecting the mechanical parts that are built into the interior of the substantially spherical body 31 from an external force.

The strut 41 of the strut unit 4 is rotatably vertically supported.

The operation of the above configuration will follow. The strut 41 is driven by the repeated rotation of the repetitive driving device 51, in order to convey a repetitive pivoting force to the pad 35, the upper wing 11 coupled to the strut 41 and the lower wing 21.

The strut 41 is formed in an inverted conical shape. In addition, the strut 41 may be conical, reverse pyramid-shaped, pyramid-shaped, or a cylindrical shape.

The operation of the above configuration will follow. The strut 41 becomes thinner towards the bottom to be light as as whole.

The strut 41 has a vertical through hole 41*a* in the axial center portion.

The operation of the above configuration will follow. The through hole 41*a* has an effect of protecting the electrical wiring for the pad drive unit 32 from the external force.

The bearing 54 disposed on the top of the housing 53 incorporates a plurality of bearings inside, which are not shown. Note that the bearing 54 may be disposed within the housing 53.

The operation of the above configuration will follow. The bearing 54 has the effect of rotatably vertically supporting the struts 41.

The strut 41 is provided with a coupling surface 43 and the locking mechanism 42 above the posts 41. The locking mechanism 42 is provided with a lock pin and a spring inside which are not shown. Incidentally, the locking mechanism 42 may be a screw.

The operation of the above configuration will follow. The connecting surface 43 is a sliding surface for causing the pad drive unit 32 to slide and rotate to left or right. The locking mechanism 42 has the effect of connecting the pad driving unit 32 to the strut 41.

The repetitive driving device 51 includes a brushless DC motor 51, a worm reduction gear 51*b*, a rotation/repeat conversion mechanism 51*c*. In addition, the brushless DC motor 51*a* may be a AC motor or a pulse motor. In addition, the worm reduction gear 51*b* may be a hypoid reduction gear. In addition, the rotational/repetitive conversion mechanism 51*c* may be externally attached above the worm reduction gear 51*b*.

The operation of the above configuration will follow. The rotation of the brushless DC motor 51*a* is, after deceleration in the worm reducer 51*b*, converted into repetitive motion through a rotational/repeat conversion mechanism 51*c*, so as to allow the strut 41 to repeat rotation within the swing angle of 0 to 120 degrees. In addition, the repetitive drive unit 51 has a silent action without brush sliding sound and shockless action that automatically repeats the acceleration after the reversal and the reduction of the previous inversion.

The control unit 52 housed in the housing 53 is provided with a stepless speed control unit 52*a*, the constant speed control unit 52*b*, and the hand operating unit 52*c*. Incidentally, the hand operation unit 52*c* may be a wireless operating unit. Moreover, the constant speed control unit 52*b* may be a two-step speed control of the high speed/low speed.

The operation of the above configuration will follow. Although not illustrated, the stepless speed control section 52*a* has the effect that the rotational speed of the brushless DC motor 51*a* can be widely controlled by adjusting the volume in the hand operation unit 52*c*. Although not illustrated, the constant speed control unit 52*b* can control inching the rotational speed of the attached torque limiter DC geared motor 32*a* using the push button in the hand operation unit 52*c*.

The housing 53 is a semi-sealed structure in the substantially trapezoidal, so that the control unit 52 and the repetitive driving unit 51 are housed inside. A plurality of air vents 53*a* and a plurality of exhaust 53*b* are disposed on the outer peripheral surface of the housing 53. In addition, natural ventilation may be a forced ventilation.

The operation of the above configuration will follow. The housing 53 has the effect of protecting the iteration drive device 51 and the control device 52 which are housed from external force. Also it has the effect that the heat generated internally can be put on the air flow coming from the air vent 53*a* below out of the above the exhaust port 53*b*.

Base plate 61 is configured by weight of the substantially rectangular and is provided with the footrest 62 which is a wave-like elastic body having a slip in front of the base plate 61, a slip stopper 63 in the four corners, fixing screws 64, and casters 65. Note that the footrest 62 may be a dome-shaped elastic body. Further, the slip stopper 63 may be attached to a urethane rubber, or silicone rubber. In addition, the slip member 63, the fixing screw 64, and the casters 65 may be combined. When installing the base plate 61 in a narrow space such as a bed, the base plate 61 may be small squares or a round shape, and fixed with screws to the mounting surface.

The operation of the above configuration will follow. The base plate 61 is composed of a heavy object. By tightening the fixing screw 64, the weight of the body A moves from the casters 65 to the slip member 63, and can be fixed to the installation surface of the main body A due to the frictional force.

Figure 2:
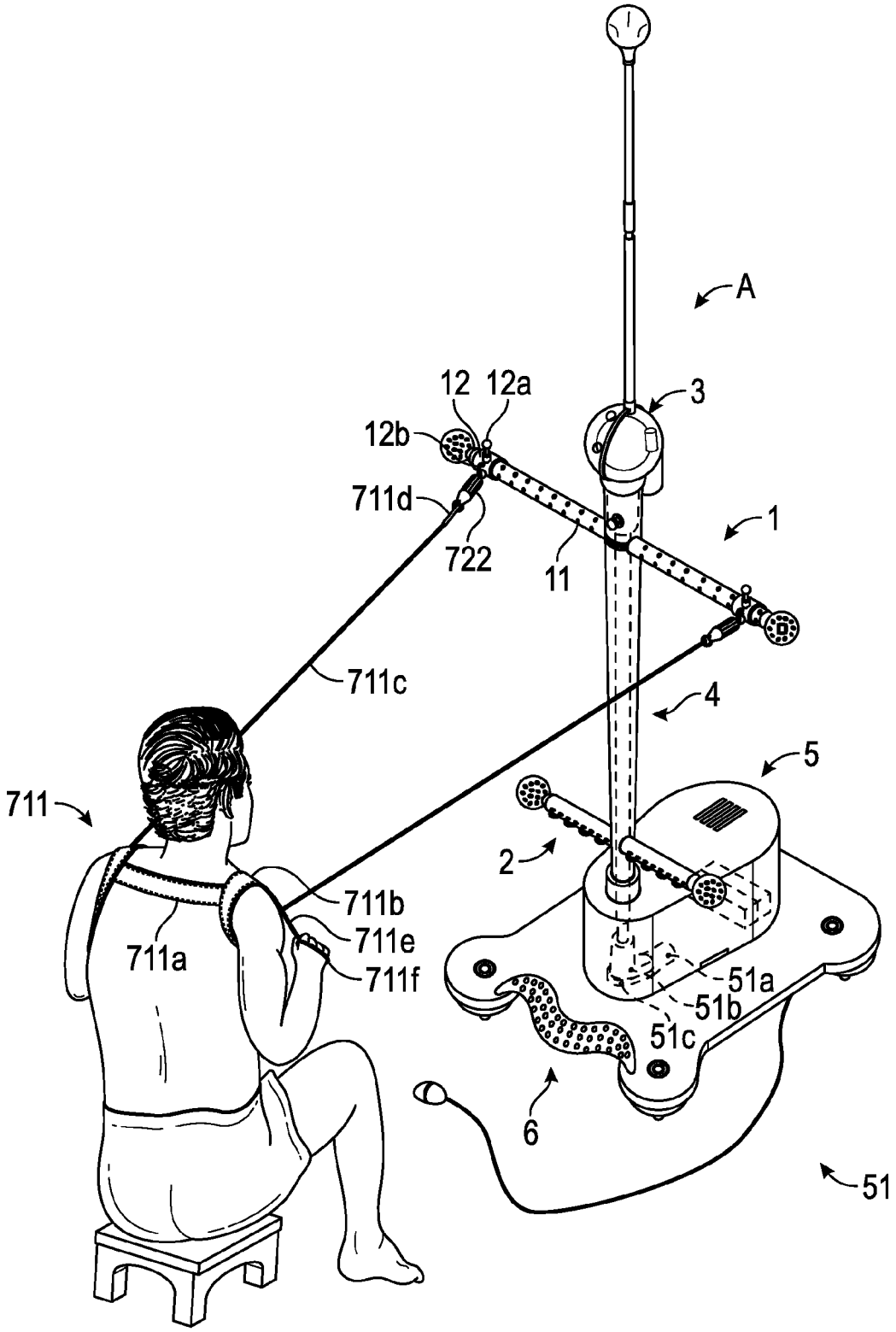
FIG. 2 is a perspective view showing a usage state of the body A and the shoulder pad 711.

FIG. 2 is a perspective view showing a usage state of the body A and the shoulder pad 711. The shoulder pad 711 is formed by: the annular band 711*b* fixed to the elastic belt 711*a*; a coupling cord 711*c* having a hook 711*d* movably coupled along the ring of the annular band 711*b*; and a cord 711*e* with a gripping ring 711*f*. The fatigue recovery effect of the upper body can be expected by the following actions in a sitting posture: first, mounting the shoulder pad 711 on a shoulder; connecting the hooks 711*d* to the retaining ring 12*b* through the preload device 722; gripping the gripping ring 711*f*; then activating the repetitive driving apparatus 51; and performing the upper body twisting motion while propagating twisting into the shoulder, the scapula, back and the abdomen.

Figure 3:
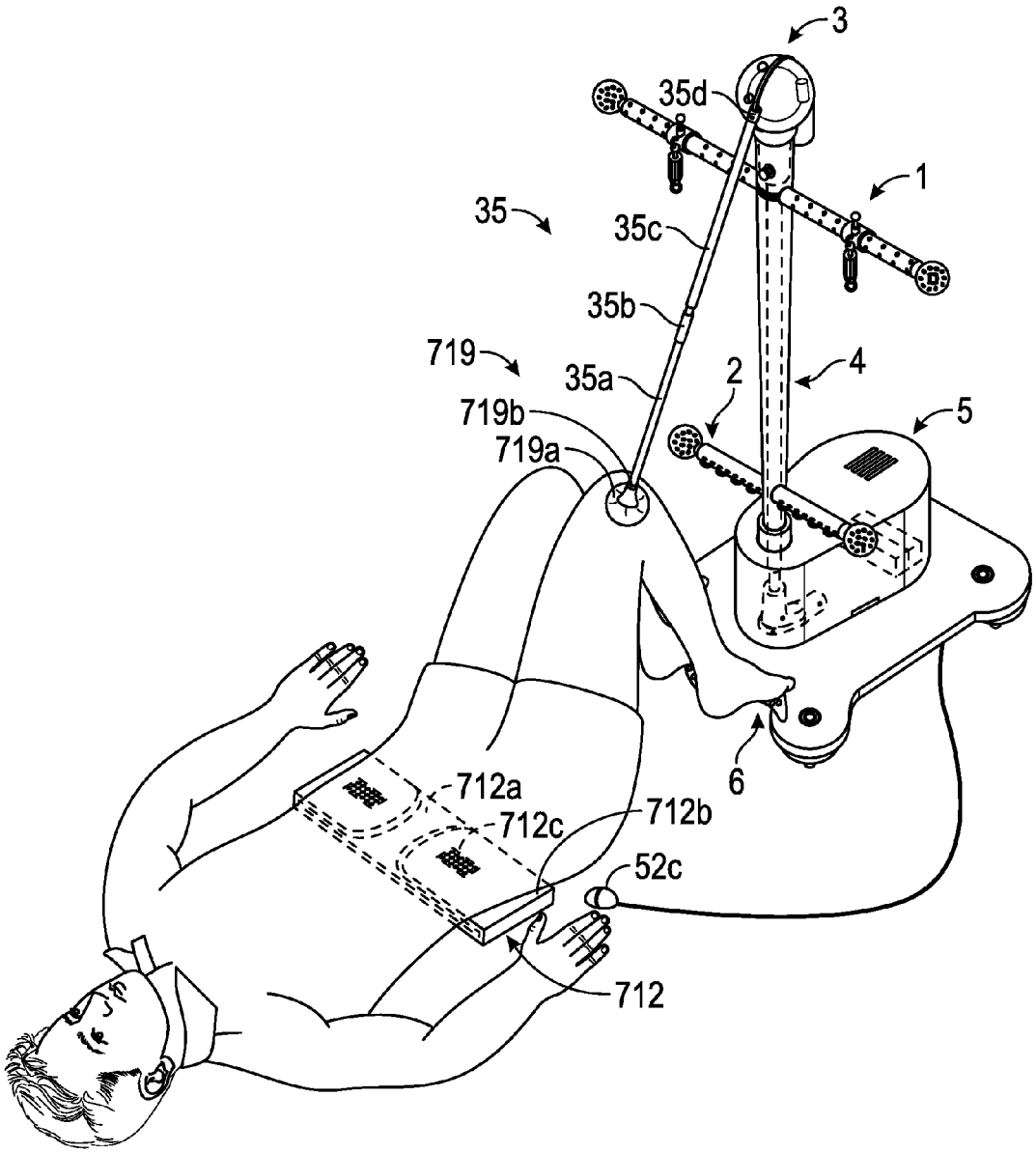
FIG. 3 is a perspective view showing the use state of the body A and spherical pad 719 and pelvic rug pad 712.

FIG. 3 is a perspective view showing a usage state of the body A, the spherical pad 719 and the pelvic rug pad 712. The spherical pad 719 is formed by the distribution spherical elastic body 719*a*, and one-touch device 719*b*. Furthermore, the pelvic rug pad 712 is formed by the mat 712*a*, the surface fastener 712*c* arranged on the mat 712*a*, and the substantially a semicircular plate-shaped elastic member 712*b* arranging the inclined surface on the arcuate peripheral portion which are movably symmetrically fixed.

Following actions are conducted for distortion preventive effect of pelvis and fatigue of lower body: attaching the spherical pad 719 at the tip of the pad 35; then being in a supine position; spreading the pelvis coverings pad 712 to the buttocks; starting the iteration drive unit 51; laying with the spherical pad 719 while folding the standing knee; and performing lower body twisting movement to propagate the torsion to the leg, thigh, pelvis, abdomen, hips and the back while performing a pelvic movement at the same time.

Figure 4:
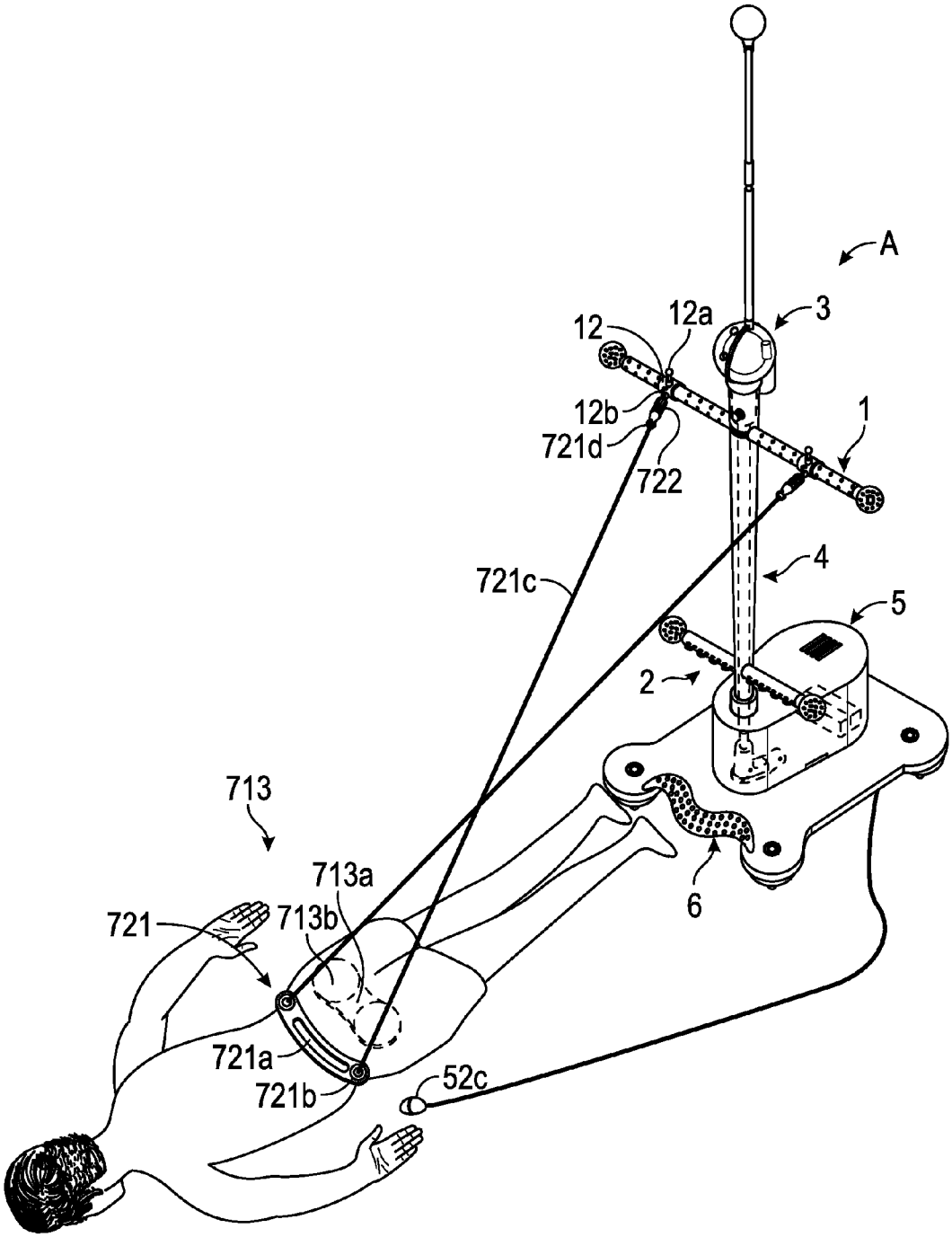
FIG. 4 is a perspective view showing the use state of the body A belly waist shared rug pad 713 and waist belt 721.

FIG. 4 is a perspective view showing a usage state of a main body A, the rug pad for both abdomen and waist 713 and the waist belt 721. The rug pad for both abdomen and waist 713 is formed by: a substantially rectangular elastic member 713*a* vertically curved like an arch shape so that the central portion is lowered and the right and left end sides are high; and a circular flat elastic body 713*b* symmetrically disposed on the substantially rectangular elastic member 713*a* from a plan view and a double-half circle shape like Kagami Mochi from a side view so that the upper surface is inclined upward toward the front.

Furthermore, the waist belt 721 is formed by: the belt attaching surface fastener 721*a*, a ring 721*b* that are attached to both side surfaces of the belt 721 and the elastic coupling cord 721*c* with a hook 721*d*. Following actions are conducted for metabolic preventive effect of the abdomen: first attaching the waist belt 721 to the waist, connecting the hooks 721*d* to the retaining ring 12*b* via the preload device 722, then prone to become a posture, laying the lower abdomen on the rug pad for both abdomen and waist 713, starting the iteration drive device 51, and performing the abdomen waving motion while swung to the left and right of the lower abdomen.

Figure 5:
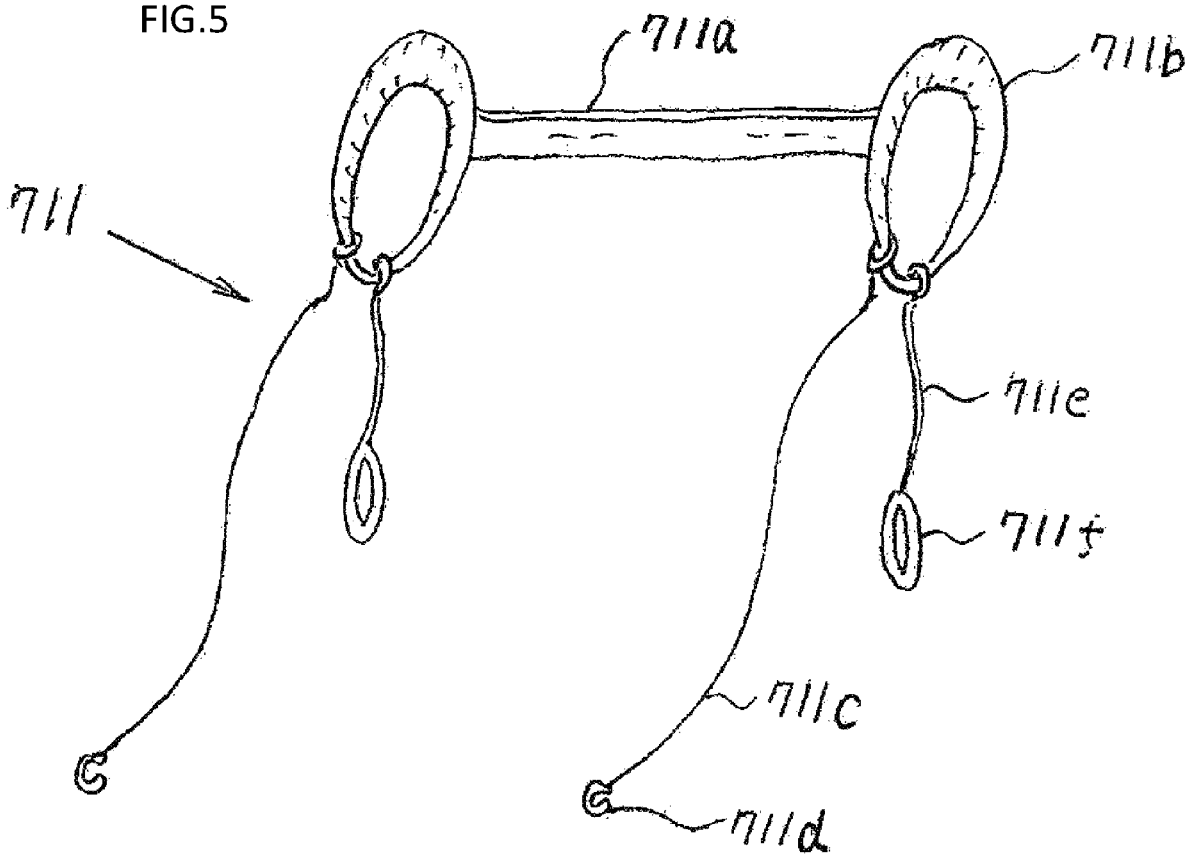
FIG. 5 is a perspective view of a shoulder pad 711.

FIG. 5 is a perspective view showing the shoulder pad 711. The shoulder pad 711 is formed by: the annular band 711*b* fixed to both ends of the elastic belt 711*a*; a coupling cord 711*c* with hooks 711*d* movably coupled along the ring of the annular band 711*b*; a cord 711*e* with a gripping ring 711*f*.

The fatigue recovery effect of the upper body can be expected by the following actions in a sitting posture: first attaching the shoulder pad 711; connecting the hooks 711*d* to the retaining ring 12*b* via the preload device 722; gripping the gripping ring 711*f*; then activating the repetitive driving device 51; and performing the upper body twisting motion while propagating twisting into the shoulder, scapula, back, and the abdomen.

Figure 6:
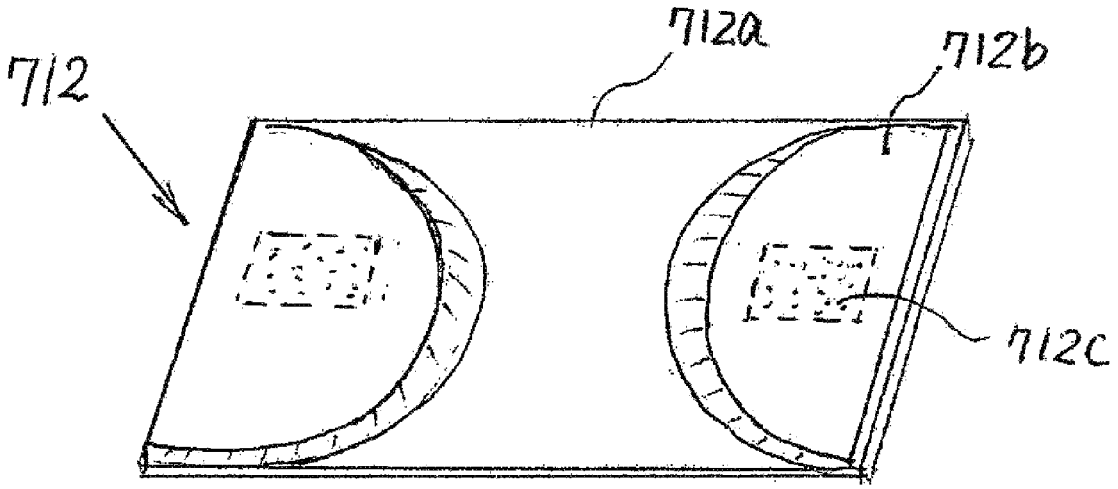
FIG. 6 is a perspective view of a pelvic rug pad 712.

FIG. 6 is a perspective view showing the pelvic rug pad 712. The pelvic coverings pad 712 is formed by: the mat 712*a* and the substantially semicircular plate-like elastic body 712*b* fixed by the face fastener 712*c* to be symmetrically movable on the mat 712*a*, providing the inclined surface on the arcuate peripheral portion.

The lower body fatigue and pelvic distortion preventive effect can be expected by the following actions in a sitting posture: first, attaching the ball pad 719 at the tip of the pad 35, then spreading the buttocks on the pelvic rug pad 712 in a supine position, starting the iteration drive unit 51, laying knees with the ball pad 719 while lower body vertical twisting movement to propagate the twisting into the legs, thighs, pelvis, abdomen, hips and the back, and performing the contact pressure movement in the pelvis sides simultaneously. In addition, according to the pelvis for rug pad 712, the surface may be soft and have an elastic hard body inside. Further, the surface fastener 712*c* can be as the locking due to the uneven formation, although not shown.

Figure 7:
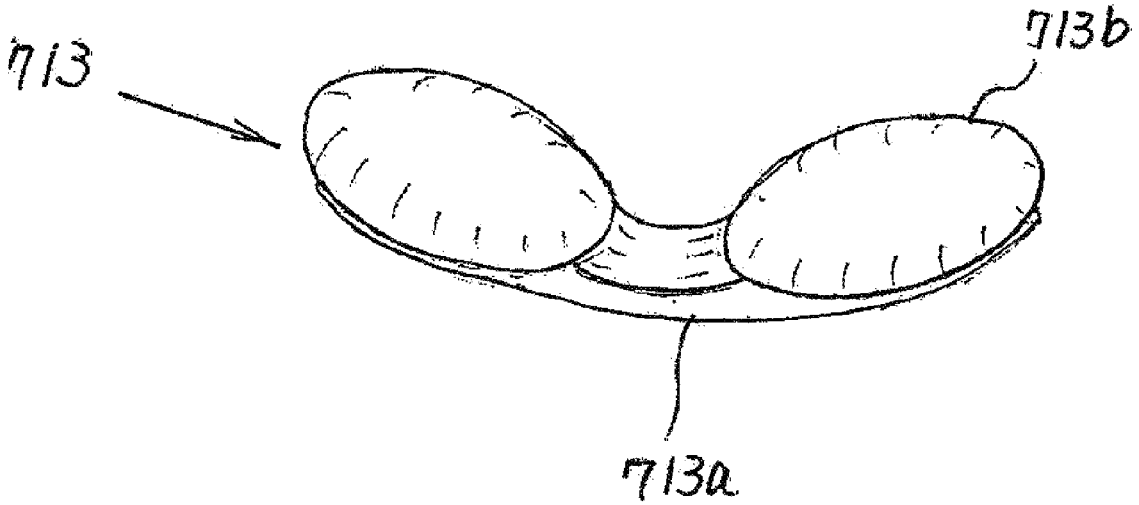
FIG. 7 is a perspective view showing the Harakoshi combination rug pad 713.

FIG. 7 is a perspective view showing the rug pad for both abdomen and waist 713. The rug pad for both abdomen and waist 713 is formed by: a substantially rectangular elastic member 713*a* vertically curved like an arch shape so that the central portion is lowered and the right and left end side are high; and a circular flat elastic body 713*b* symmetrically disposed on the substantially rectangular elastic member 713*a*. Following actions are conducted for metabolic preventive effect of the abdomen: first attaching the waist belt 721 to the waist, connecting the hooks 721*d* to the retaining ring 12*b* via the preload device 722, then, laying the lower abdomen on the rug pad for both abdomen and waist 713, starting the iteration drive device 51, and performing the abdomen waving motion while swung to the left and right of the lower abdomen. In addition, according to the belly waist combined rug pad 713, the surface may be as an elastic body inside a hard soft.

Figure 8:
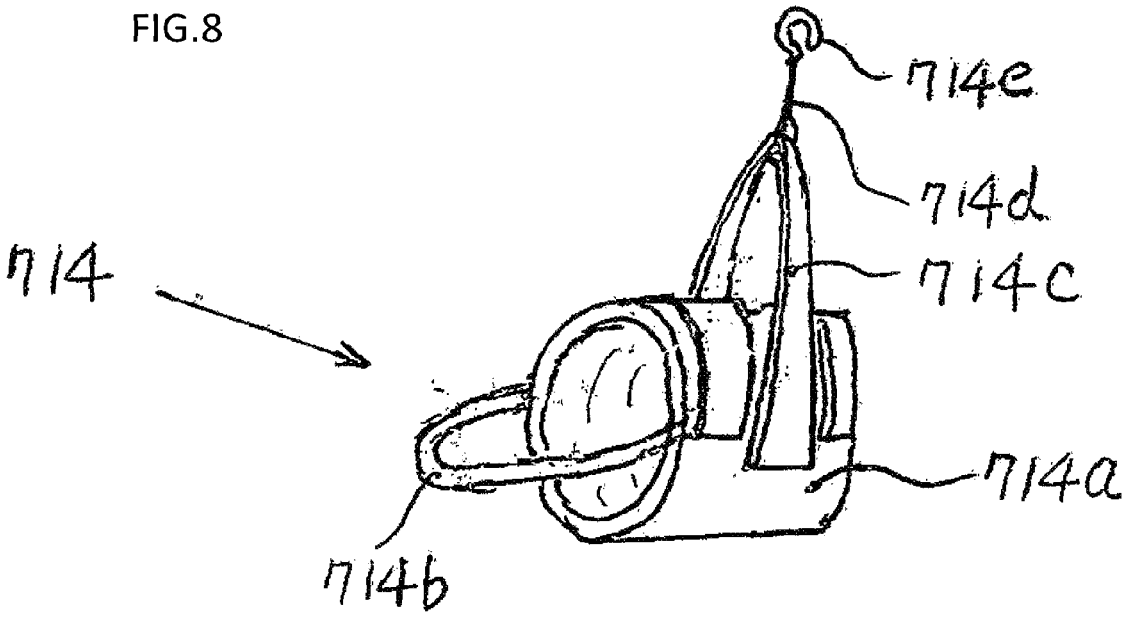
FIG. 8 is a perspective view of a foot hanging pad 714.

FIG. 8 is a perspective view of a foot hanging pad 714. The foot hanging pad 714 is formed by: the cylindrical band with the surface fastener 714*a*; stirrup-shaped leg rest 714*b*; webbing straps 714*c* attached to the side of the cylindrical band with the surface fastener 714*a*; a cord 714*d* with a hook 714*e*.

Following actions are conducted for fatigue recovery effect on the lower body and the stiffness preventive effect of the knee joint: first, inserting the crank 723 in the square hole 13*a* of the spherical elastic member 13, attaching the surface fastener with the cylindrical band 714*a* to both ankles, then becoming supine for orientation, engaging the hook 714*e* in stop hole 723*e* of the crank 723, launching the repetitive drive unit 51, and carrying out the bending and stretching motion of the legs. A hook 714*e* may be engaged with the stop ring attached to the lower part of the spherical elastic member 13, although not shown.

Figure 9:
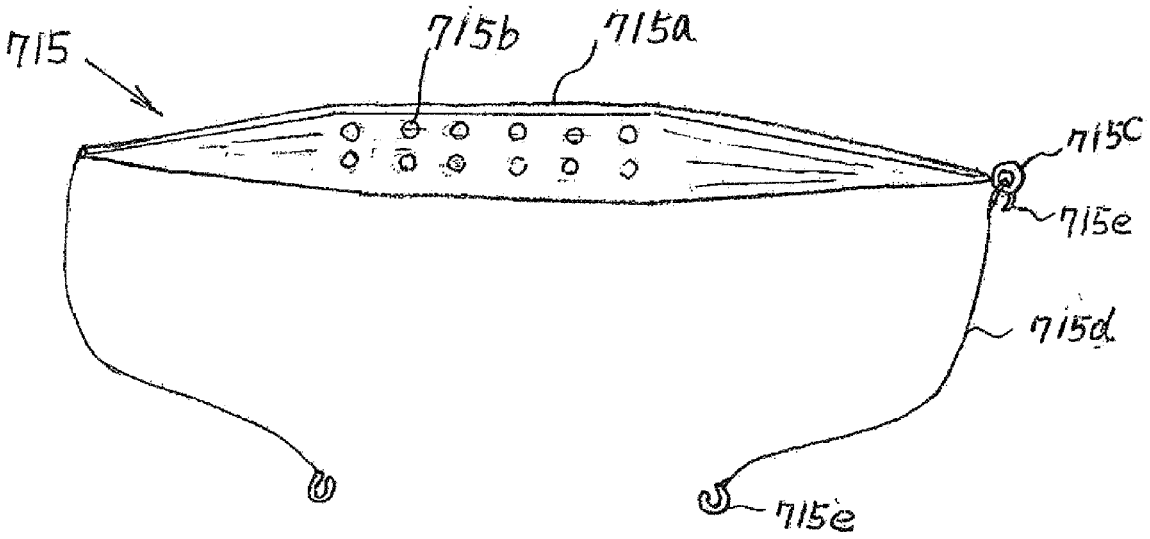
FIG. 9 is a perspective view of a calf pad 715.

FIG. 9 is a perspective view of a calf pad 715. The calf pad 715 is formed by: the belt-shaped elastic body 715*a* on which a plurality of hemisphere elastic bodies 715*b* are disposed; the ring 715*c* fixed to both ends of the belt-shaped elastic body 715*a*, and a connecting cord 715*d* with both ends hook 715*e*.

The calf swelling preventive effect can be expected by the following actions in a sitting posture: first mounting the calf pad 715 so as to wrap around the calf, connecting the hook 715*e* to the retaining ring 12*b* via the preload device 722, then activating the repetitive driving device 51 and performing the calf of twist movement. It is also possible to intermittently form an opening for the passage of the hook 715*e* in the longitudinal direction of the center line of which is not shown the stretch band elastic member 715*a*.

Figure 10:
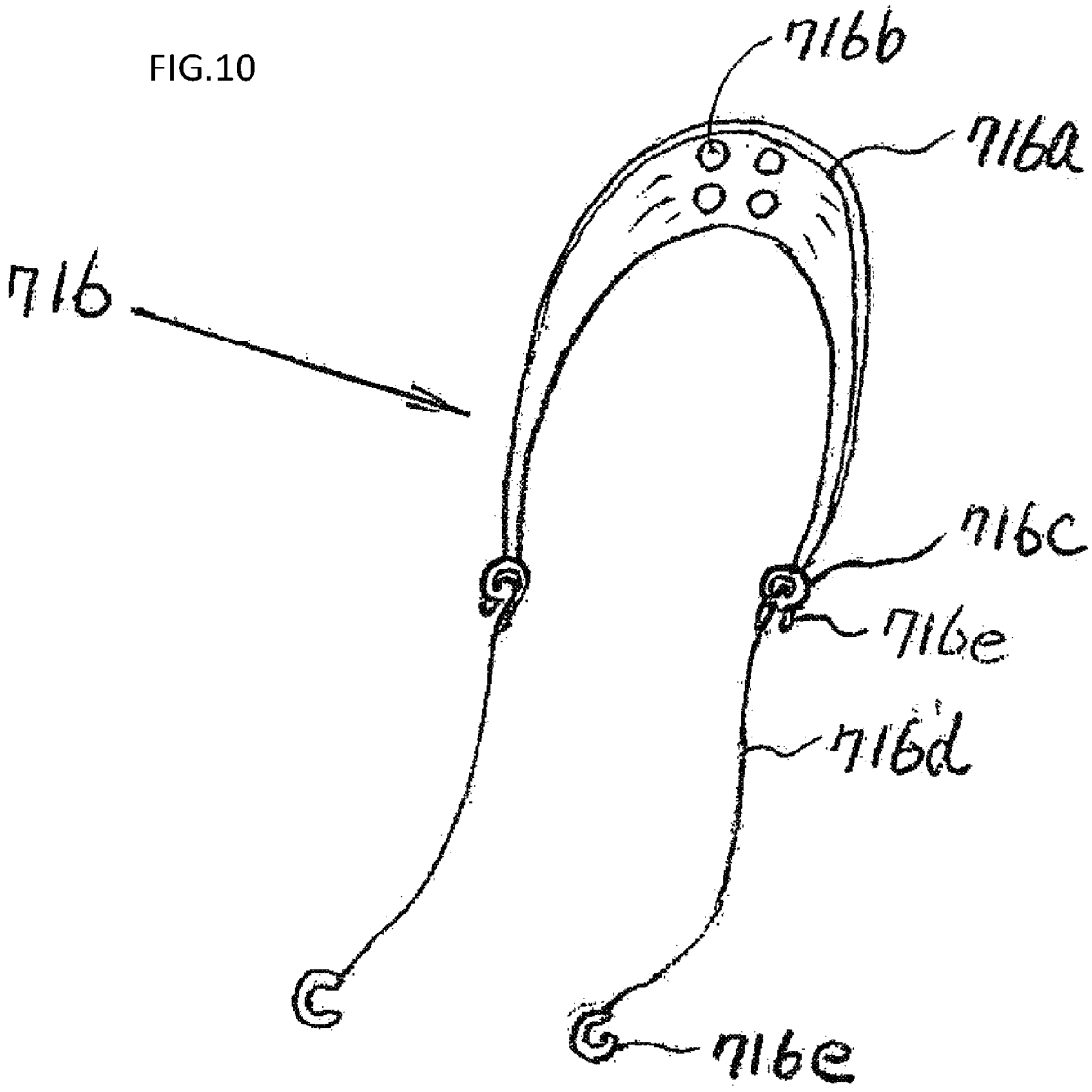
FIG. 10 is a perspective view showing a head pad 716.

FIG. 10 is a perspective view of a head pad 716. The neck pad 716 is formed by: a band-like elastic member 716*a* in which a plurality of hemispherical elastic members 716*b* are arranged, the ring 716*c* fixed to both ends of the band-like elastic member 716, and a coupling cord 716*d* with hooks 716*e*.

The fatigue recovery effect of the neck can be expected by the following actions in a sitting posture: first attaching the neck pad 716 to the neck, connecting the hook 716*e* to the retaining ring 12*b* via the preload device 722, then activating the repetitive driving device 51, and performing the twisting motion of the neck.

Figure 11:
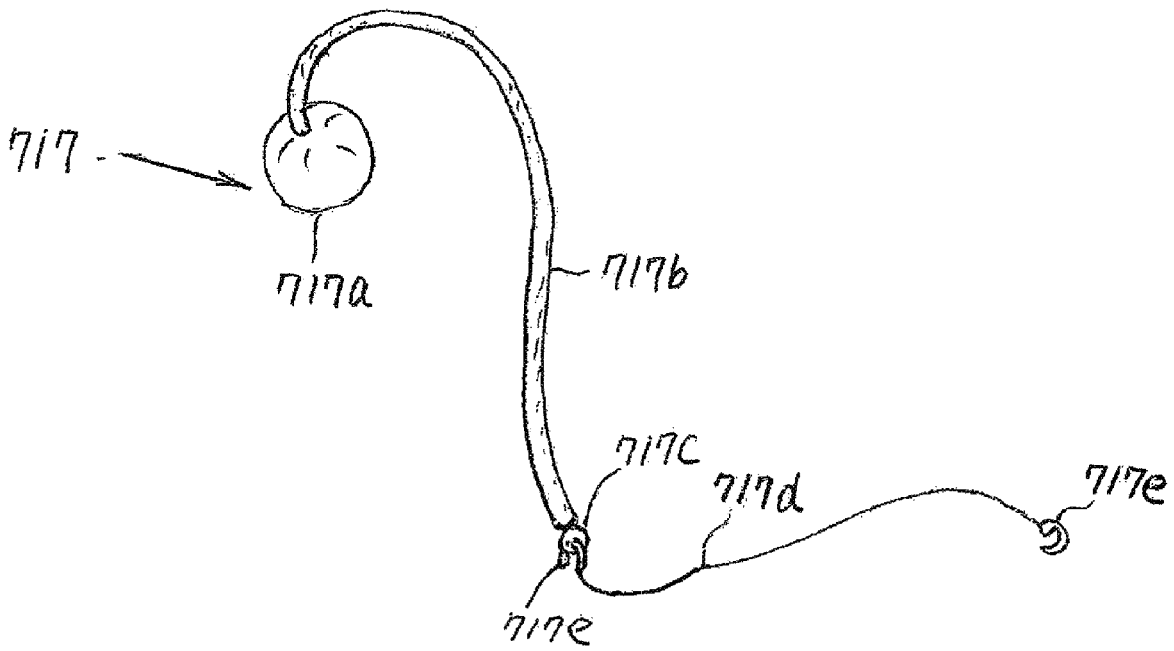
FIG. 11 is a perspective view of a pressing pad 717.

FIG. 11 is a perspective view of a pressing pad 717. The pressing pad 717 is formed by: the spherical elastic body 717*a*, a curved rod 717*b*, the ring 717*c* fixed to the lower end of the curved rod 717*b*, and the coupling straps 717*d* with hook 717*e*.

The preventive effect of stiff neck can be expected by the following actions in a sitting posture: first connecting the hook 717*e* to the retaining ring 21*a*, putting the pressing pad 717 on the shoulder, then activating the repetitive driving unit 51, and performing the pushing movement of the shoulder. It should be noted that the spherical elastic body 717*a* may be soft on the surface and have a hard body inside.

Figure 12:
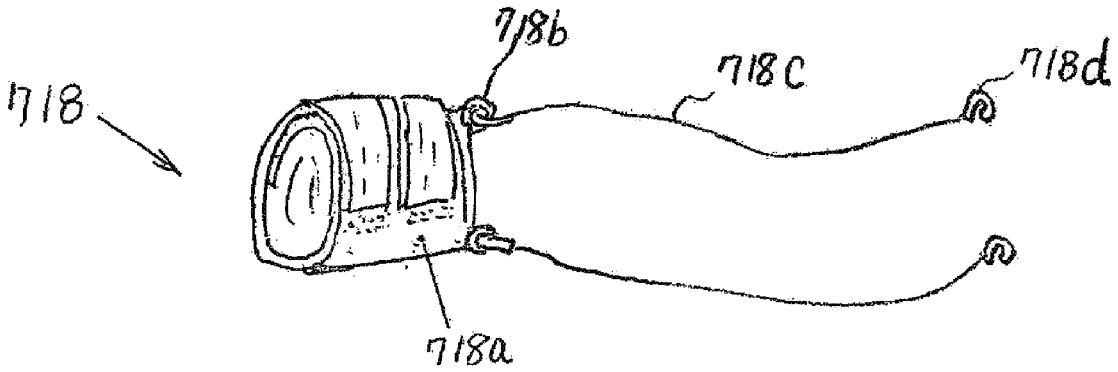
FIG. 12 is a perspective view of a foot traction pad 718.

FIG. 12 is a perspective view of a foot traction pad 718. The leg traction pad 718 is formed by: a cylindrical band 718*a* with a surface fastener, and the ring 718*b* attached to one end of the cylindrical band 718*a*, and an elastic coupling cord 718*c* with a hook 718*d*. An effect of relieving the stress of the leg can be expected by the following actions: first mounting the leg traction pad 718 on both ankles, connecting the hook 718*d* in the retaining ring 21*a*, then becoming prone posture, starting the iteration drive device 51, and performing traction movement of the left and right legs alternately. In addition, the elastic coupling cord 718*c* may be rubber straps or a spring.

Figure 13:
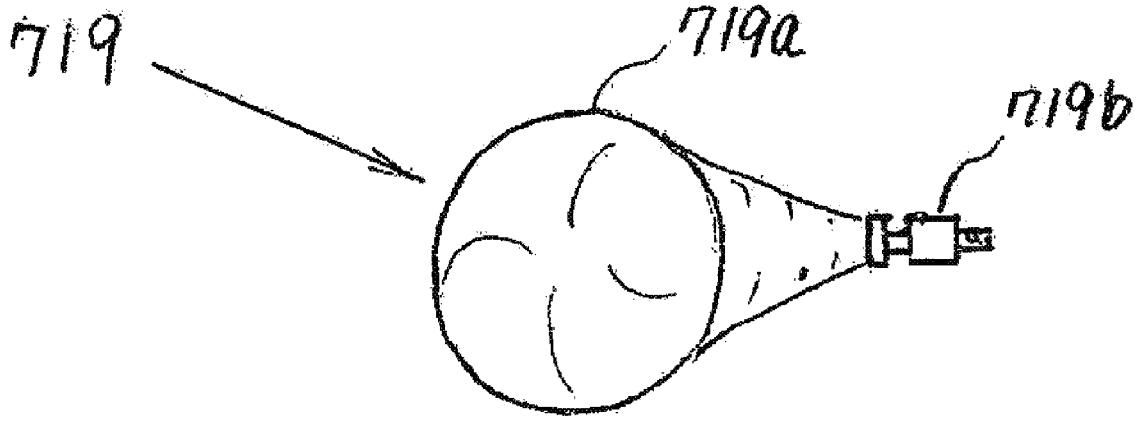
FIG. 13 is a perspective view of a spherical pad 719.

FIG. 13 is a perspective view of the spherical pad 719. The spherical pad 719 is rotatably formed by: an spherical elastic body with slope 719*a*, and a one-touch device 719*b*. Following actions are conducted: first attaching the spherical pad 719 at the tip of the pad 35, starting the repetitive driving unit 51 to become a sitting posture, then activating the pad driving unit 32, moving the pad 35 upward or downward while planarly hitting the back and allowing the effect of relieving the back rest. In addition, spherical pad 719 may be hollow or used as the solid. The gradient of the spherical pad 719 may be a resilient member or spring having flexibility.

Figure 14:
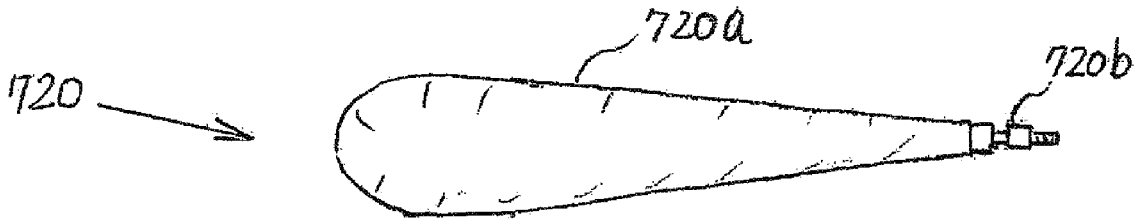
FIG. 14 is a perspective view of a rod-shaped pad 720.

FIG. 14 is a perspective view of a rod-shaped pad 720. The rod-shaped pad 720 is rotatably formed by the rod-shaped elastic member 720*a* which widens toward the front end, and the one-touch fitting 720*b*. Following actions are conducted: first attaching a rod-shaped pad 720 to the tip of the pad 35, in a supine position, laying the rug pad for both abdomen and waist 713 on the waist, then, activating the repetitive apparatus 51 so as to lightly sandwich the rod-shaped pad 720 with both feet, performing a waving movement of the hips, and allowing fatigue recovery effect of the waist. In addition, the rod-like elastic body 720*a* may be soft on the surface, and a hard body inside.

Figure 15:
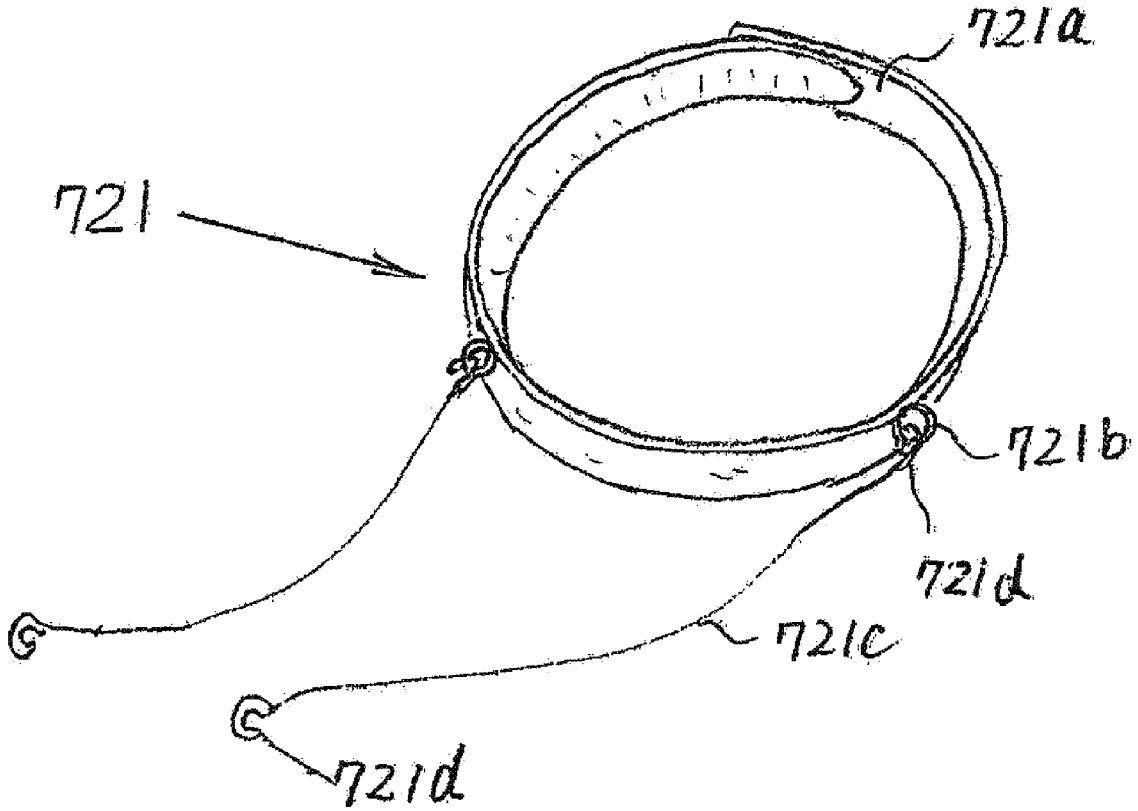
FIG. 15 is a perspective view of a waist belt 721.

FIG. 15 is a perspective view of a waist belt 721. The waist belt 721 is formed by: the imposition fastener belt 721*a*, a ring 721*b* attached to both side surfaces of the belt 721*a*, and an elastic coupling cord 721*c* with a hook 721*d*. Following actions are conducted: first attaching the waist belt 721 to the waist, connecting the hooks 721*d* through the preload member 722 to the retaining ring 12*b*, then laying the rug pad for both abdomen and waist 713 on the lower abdomen, activating the repetitive driving unit 51, performing the contact pressure movement of the lower abdomen while swinging the lower body to the left and right, and allowing metabolic preventive effect of the abdomen. It should be noted that the elastic coupling cord 721*c* may be rubber straps or a spring.

Figure 16:
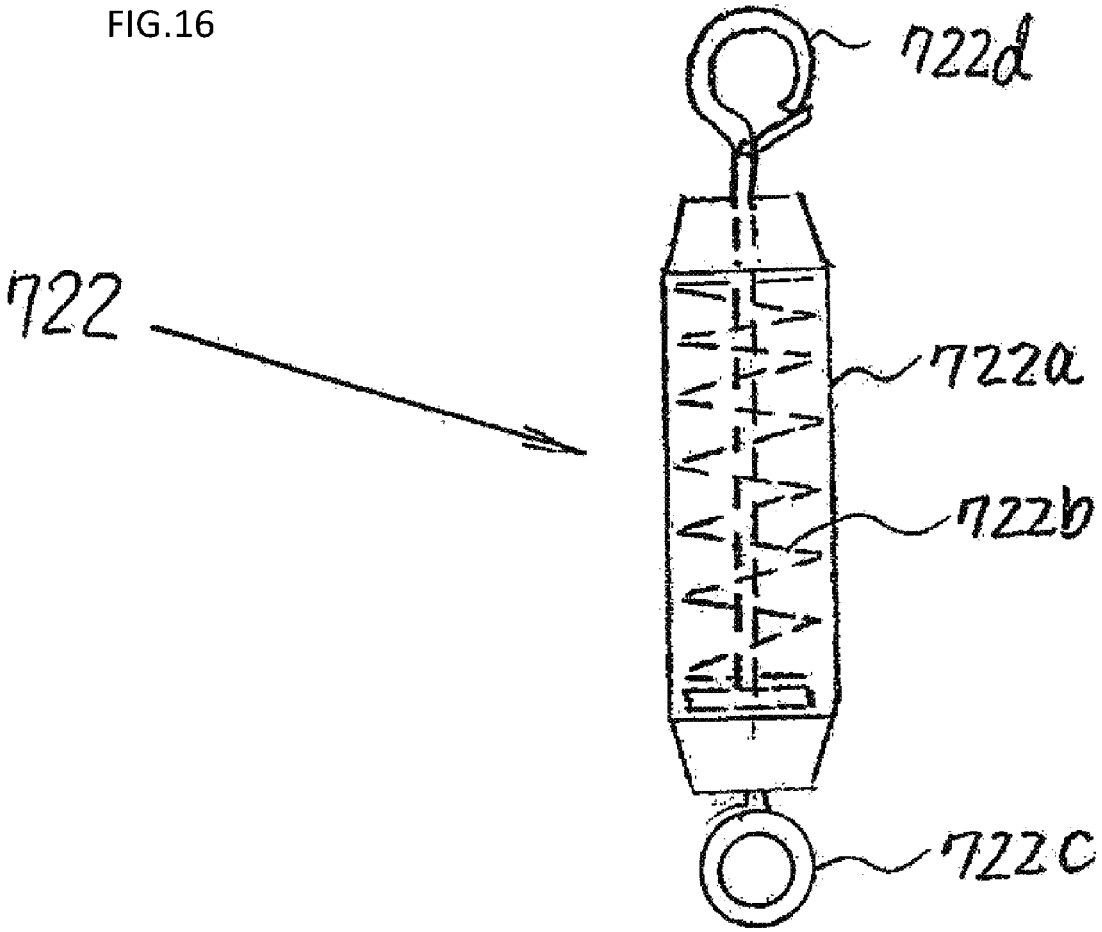
FIG. 16 is a perspective view showing a preload member 722.

FIG. 16 is a perspective view showing the preload member 722. The preload 722 includes a case 722*a*, a spring 722*b*, the movable ring 722*c*, and a hook 722*d*. The preload fixture 722 applies a tensile force on a pad portion 7 mounted on the body, allowing the exercise to be performed smoothly.

Figure 17:
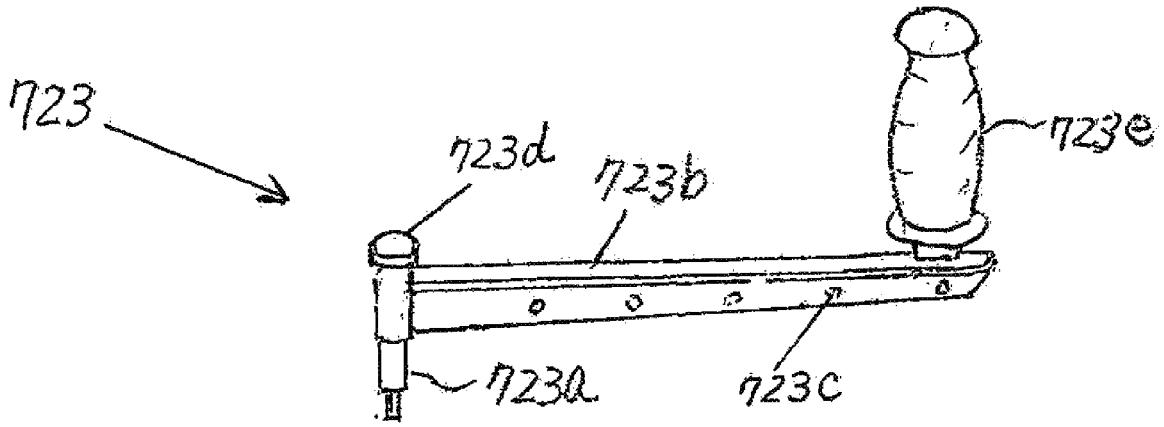
FIG. 17 is a perspective view showing a crank 723.

FIG. 17 is a perspective view showing the crank 723. The crank 723 is configured by: the fixed shaft 723*a* with a tip forming the square bar, an arm 723*b* rotatably attached, the clamp 723*c* for securing the arm 723*b*, a rotatable grip 723*d*, and a plurality of small holes 723*e*. Following actions are conducted: first inserting the fixed shaft 723*a* in the square hole 13*a*, then starting the iteration drive unit 51, holding the grip 723*e* to fully turn both arms to match back and forth motion of the upper wing 11, and allowing stiffness preventive effect of wrist, elbow and shoulder.

Figure 18:
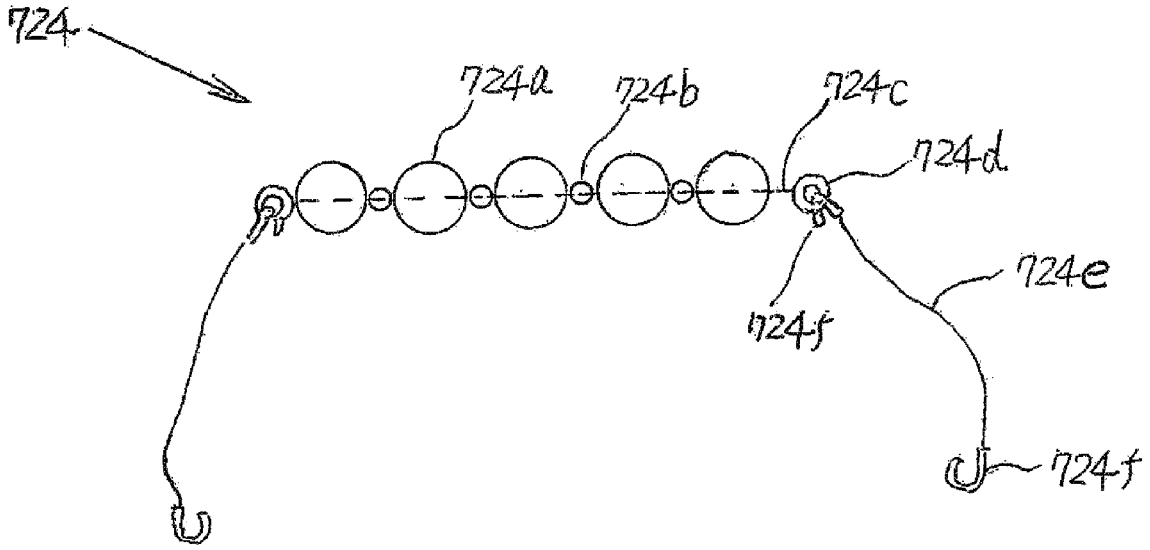
FIG. 18 is a perspective view of a continuous ball pad 724.

FIG. 18 is a perspective view of a continuous ball pad 724. The communication sphere pad 724 is configured by: a macrocytic elastic body 724*a* having a through hole in the center, the small sphere elastic body 724*b*, the stretchable through-string 724*c*, a ring 724*d* attached to the through cord 724*c*, and a coupling cord 724*e* with hook 724*f*.

The thigh cellulite preventive effect can be expected by the following actions in a sitting posture: first winding the continuous ball pad 724 to the thigh or the like, connecting the hook 724*f* to the retaining ring 12*b* via the preload device 722, then activating the repetitive driving unit 51, and carrying out the thighs of twisting motion. Incidentally, communication spheres may be increased gradually toward the center smaller at both ends.

Figure 19:
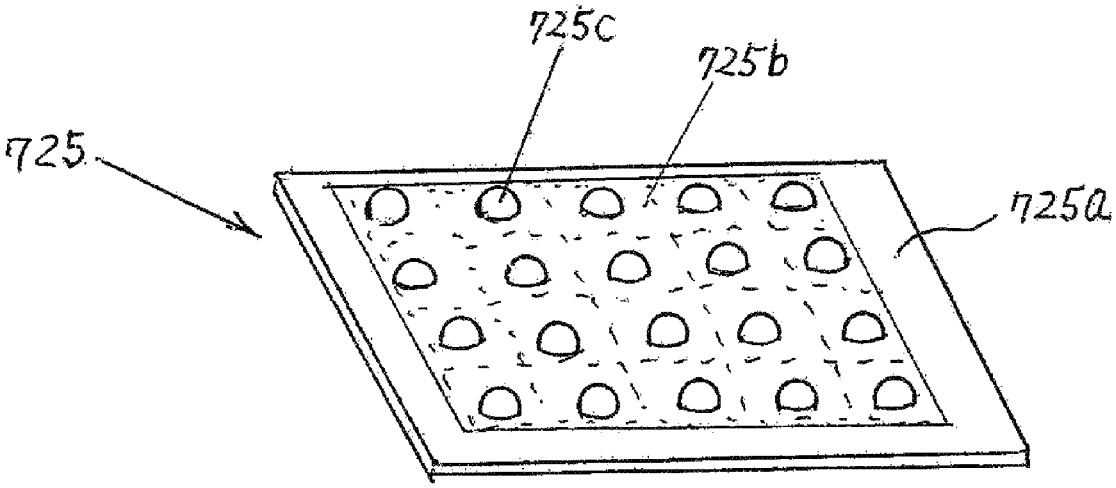
FIG. 19 is a perspective view showing a thermal pad 725.

FIG. 19 is a perspective view showing a thermal pad 725. The thermal pad 725 with a temperature controller is formed by a rectangular mat 725*a* which has an electric heater 725*b* therein, and the hemispherical elastic member 725*c* that is a plurality disposed on the mat 725*a*.

Following actions are conducted: first attaching the waist belt 721 to the waist, connecting the hooks 721*d* through the preload member 722 to the retaining ring 12*b*, then laying the thermal pad 725 on the abdomen or the like, activating the repetitive driving device 51, performing a waving movement of the abdomen like while swinging the abdomen to the left and right, and allowing cellulite prevention effect of the abdomen. Incidentally, the electric heater may be a self-heating control planar heating element without requiring the temperature control. Although not shown, it is possible to attach the tip of the pad 35 to a pulley with a one-touch device, to grasp the end of the cord through the pulley and to perform the vertical movement while grasping one end with the left hand and the other end with the right hand, relieving such shoulder pain. Although not shown, it can be fitted with a fan at the tip of the pad 35 as an application example. When the iteration drive unit 51 is started, the breeze occurs and does not interfere with the infant's sleep sleeping. Although not shown, by attaching the toy attracting pets at the tip of the pad 35 as an application example and activating the repetitive drive unit 51, the toy is moving to attract pets, solving lack of exercise problem for the pet.

Multipurpose fitness equipment is applicable to a high kinetic posture degree of freedom. In addition to the torsional movement, it can be applied to rehabilitation, pelvis diet, massage, stretching, cellulite prevention, metabolic syndrome prevention, requiring support prevention of the elderly, care prevention, sports injury care, lack of exercise and the like.

While this present disclosure has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A multipurpose fitness device that comprises a main body and a pad unit, wherein the main body comprises a strut and a repeat drive unit for generating a torsional force on parts of a human body, the strut being vertically supported to pivot, the repeat drive unit being arranged connectable to a lower tip of the strut in order to repeatedly rotate the strut; the main body further comprising:

an upper wing which is substantially rod-shaped, fixed to an upper side of the strut to be horizontally symmetric in order to impart a swirling force around the vertical axis of the strut in a back or forward direction with respect to the human body; and a pad driver, fixed to a pad, connectable to the upper side of the strut in order to impart a swirling force in a horizontal direction with respect to the human body around the vertical axis of the strut and a swirling force in a vertical direction with respect to the human body around the horizontal axis of the strut; wherein the pad unit is an accessory that is removably connected to the upper wing or adhered to the pad, and configured to transmit the swirling force in back, forth, horizontal and vertical directions with respect to the main body.

2. The fitness device according to claim 1, wherein the repeat drive unit comprises an automatically repeated rotator of the strut at a predetermined swing angle, providing a back and forth swirling force on the upper wing around the longitudinal axis of the strut with respect to the human body and providing a swirling force in the lateral direction to the pad around a longitudinal axis with respect to the pad driver.

3. The multi-purpose fitness device according to claim 1, wherein the pad drive device comprises a coupling unit slidably rotatably connected to the strut top, freely changing the lateral direction of the orientation of the pad drive device around the longitudinal axis of the strut within a range of a predetermined angle.

4. The multi-purpose fitness device according to claim 1, wherein the pad drive device comprises a pivoting unit for movement of the pad within the predetermined angle in a vertical direction around a horizontal axis of the pad driving unit.

5. The multi-purpose fitness device according to claim 1, wherein the pad unit is a pad for shoulders of the human body comprising an annular ring band fixed to both ends of an elastic belt, a cord with a hook and a cord with a grip ring, each cord being movably connected with the ring of the annular band.

* * * * *